US008960669B2

(12) United States Patent
Cappello et al.

(10) Patent No.: US 8,960,669 B2
(45) Date of Patent: Feb. 24, 2015

(54) METHOD FOR DOT PRINTING ON CARDS

(75) Inventors: Paolo Cappello, Ivrea (IT); Mauro Mondino, Ivrea (IT)

(73) Assignee: SICPA Holding SA, Prilly (CH)

( * ) Notice: Subject to any disclaimer, the term of this patent is extended or adjusted under 35 U.S.C. 154(b) by 0 days.

(21) Appl. No.: 14/124,410

(22) PCT Filed: May 23, 2012

(86) PCT No.: PCT/IB2012/052582

§ 371 (c)(1),
(2), (4) Date: Apr. 9, 2014

(87) PCT Pub. No.: WO2012/168814

PCT Pub. Date: Dec. 13, 2012

(65) Prior Publication Data

US 2014/0225954 A1 Aug. 14, 2014

(30) Foreign Application Priority Data

Jun. 7, 2011 (IT) ..... MI2011A1022

(51) Int. Cl.
*B65H 9/00* (2006.01)
*B41J 2/01* (2006.01)
*B41J 13/12* (2006.01)

(52) U.S. Cl.
CPC .. *B41J 13/12* (2013.01); *B65H 9/00* (2013.01)
USPC ..... 271/236; 271/234; 271/267; 347/4; 347/104

(58) Field of Classification Search
CPC ..... B41J 11/22
USPC ..... 271/236
See application file for complete search history.

(56) References Cited

U.S. PATENT DOCUMENTS

| | | | | |
|---|---|---|---|---|
| 4,577,854 | A * | 3/1986 | Bachmann et al. | 271/227 |
| 4,714,505 | A * | 12/1987 | Goodfellow et al. | 156/64 |
| 5,423,619 | A | 6/1995 | Kohno | |
| 2003/0024422 | A1 | 2/2003 | Pribula et al. | |
| 2004/0217545 | A1 * | 11/2004 | Kurita et al. | 271/236 |
| 2011/0185931 | A1 * | 8/2011 | Mueller et al. | 101/407.1 |

FOREIGN PATENT DOCUMENTS

WO 2004/089634 10/2004

* cited by examiner

*Primary Examiner* — Shelby Fidler
(74) *Attorney, Agent, or Firm* — Greenblum & Bernstein, P.L.C.

(57) ABSTRACT

A method and dot printer for dot printing on a card. A method includes receiving a card on a plate-like element of a carriage in a manner that a lateral movement of the card one of on or above the plate-like element is stopped by an abutment element, moving the plate-like element and card in a direction crosswise to the lateral movement until a main side of the card abuts a first abutment surface of an abutment structure and a main edge of the plate-like carrier abuts a second abutment surface of the abutment structure. The first abutment surface and the second abutment surface are not coplanar. The method also includes transporting the plate-like element and the card in a direction away from the abutment structure to a printing station and activating the printing station for dot printing on the card.

23 Claims, 12 Drawing Sheets

METHOD FOR DOT PRINTING ON CARDS

CROSS-REFERENCE TO RELATED APPLICATIONS

The present application is a U.S. National Stage of International Patent Application No. PCT/IB2012/052582 filed May 23, 2012 and claims priority under 35 U.S.C. §119 and 365 of Italian Patent Application No. MI2011A001022 filed Jun. 7, 2011. Moreover, the disclosure of International Patent Application No. PCT/IB2012/052582 is expressly incorporated by reference herein in its entirety.

BACKGROUND OF THE INVENTION

1. Field of the Invention

The present invention refers to a method for dot printing on cards.

In particular, the invention can be used for printing on cards made of plastic material such as, for example, credit cards, smart cards, magnetic cards, etc.

2. Discussion of Background Information

As known, these cards usually bear signs, images, trademarks, that help the users to identify the purpose of the card and to distinguish each card from the others.

SUMMARY OF THE EMBODIMENTS

The Applicant has found that, in order to obtain satisfactory results from the printing process, it is important that the position of the card to be printed is precisely determined, so that the ink ejected by the printhead lands exactly on the expected spot on the card's surface and, step by step, a correct printing is performed.

In particular, the Applicant has verified that it is important that the card to be printed is precisely positioned on the support carriage that moves the card inside the printer and brings it to a suitable position at the printing station.

In view of the above, it is an object of the present invention to provide a method for dot printing on cards that is capable of properly positioning the card with respect to the printing station that executes the printing process.

According to embodiments of the present invention, a method for dot printing on cards is capable of properly positioning the card to be printed on the support carriage in a simple and quick manner.

Further, in embodiments of the present invention, a method for dot printing on cards that can be executed with a structure that is simple and has reduced overall dimensions.

Embodiments of the invention are achieved by a dot printer for printing on cards according to the claims appended hereto.

Embodiments of the invention are directed to a method for dot printing on cards. The method includes activating an extraction station to move a card in a first direction toward an abutment element facing an output of the extraction device in order to place the card on a support carriage, the card having at least a main side and the support carriage including at least a plate-like element for supporting the card and the plate-like element having at least a main edge. The method also includes positioning the card on the support carriage via impingement of the card with the abutment element and via an abutment structure having a first abutment portion with a first abutment surface for the card and having a second abutment portion with a second abutment surface for the support carriage, wherein the first and second abutment surfaces are spaced a first distance from each other. Prior to placing the card, the method includes locating the support carriage in a first position in which the support carriage is interposed between the output of the extraction station and the abutment element and in which the main edge is spaced from the second abutment surface a second distance that is greater than the first distance. After the card is placed, the card extends at least in part beyond the main edge of the plate-like element so that the main side of the card is spaced a third distance from the main edge of the plate-like element that is greater than the first distance, and the method further includes moving, in a first movement, the carriage in a second direction transverse to the first direction toward the abutment structure so that the main side of the card impinges on the first abutment portion to stop at the first abutment surface and the main edge of the plate-like element subsequently impinges on the second abutment portion to stop at the second abutment surface. The method also includes transporting the card to a printing station via a main movement of the support carriage and activating the printing station for dot printing on the card.

According to embodiments, the method can also include keeping the card in abutment with the abutment element while the first movement is performed.

In accordance with other embodiments, the abutment element can define a main abutment surface for the card that is transverse to the first and second abutment surfaces. The main abutment surface may be perpendicular to the first and second abutment surfaces.

According to still other embodiments of the instant invention, the first and second directions can be perpendicular to each other.

In other embodiments, the first abutment surface is parallel to the second abutment surface.

According to further embodiments of the invention, the abutment structure can include a base portion to which the first and second abutment portions integrally mounted.

In further embodiments, in the first position, the carriage may be closer to the second abutment portion than to the first abutment portion.

In accordance with other embodiments, after the main edge of the plate-like element impinges on the second abutment portion, the method can include performing a second movement of the carriage in the second direction for a preset additional path.

In further embodiments, the carriage can be slidably mounted on a guide plate having a first portion interposed between the output of the extraction station and the abutment element and at least a second portion at the printing station, the first position may be defined on the guide plate, and the main movement, the first movement and the second movement of the carriage can be carried out by moving the carriage on the guide plate. The carriage can have a first end that is slidably and rotatably mounted with respect to the guide plate and a second end is slidably mounted on said guide plate, and the guide plate may be structured and arranged so that, when the carriage is in the first position, the plate-like element can be in a tilted condition relative to a base structure and, when the carriage is in the second position, the plate-like element can be substantially parallel to the base structure. The plate-like element can be rigidly mounted on a first support element arranged at the first end of the carriage and on a second support element arranged at the second end of the carriage. The first support element may have an end rigidly connected with the plate-like element and a through aperture for engaging a rod substantially parallel to the guide plate. The second support element can have an end rigidly connected with the plate-like element, and an opposite end slidably engaged with the guide plate. The first portion of the guide plate may include a first zone with which the second support element abuts when the carriage is in the first position, and the second portion of the guide plate may include a second zone, with which the second support element abuts when the carriage is in the second position, and the first zone can be located at a lower height than the second zone with respect to the base structure.

According to still other embodiments, the method can also include activating a suction system to secure the card to the plate-like element. The plate-like element may have one or more through holes through which the suction system acts on the card. The suction system can include a pump and at least a conduit having a first end engaged with the pump and a second end engaged with the plate-like element for connecting the through holes with the pump. The transporting of the card to a printing station may occur after the suction system is activated.

In other embodiments, the card can have a substantially plate-like shape with a substantially rectangular shape in a plan view with a larger side and a smaller side.

In accordance with still yet other embodiments of the present invention, the printing station ink-jet can print on the card.

Embodiments of the invention are directed to a dot printer for cards. The dot printer includes a carriage including at least a plate-like element structured and arranged for supporting a card having a main side, the plate-like element having at least a main edge, an extraction station structured and arranged to place the card on the support carriage, a printing station structured and arranged to dot printing on the card, an abutment element structured and arranged to face an output of the extraction station, and an abutment structure that is oriented transverse to the abutment element and includes a first abutment portion structured and arranged to define a first abutment surface for the card and a second abutment portion structured and arranged to define a second abutment surface for the carriage. The first abutment surface has a first distance greater than zero from the second abutment surface. A control system is structured and arranged to control the extraction station to place the card on the support carriage in such a manner that the card reaches the abutment element, to move the carriage so that the main side of the card reaches the first abutment surface and the main edge of the plate-like element reaches the second abutment surface, and to move the carriage to the printing station.

Embodiments of the instant invention are directed to a method that includes receiving a card on a plate-like element of a carriage in a manner that a lateral movement of the card one of on or above the plate-like element is stopped by an abutment element, moving the plate-like element and card in a direction crosswise to the lateral movement until a main side of the card abuts a first abutment surface of an abutment structure and a main edge of the plate-like carrier abuts a second abutment surface of the abutment structure. The first abutment surface and the second abutment surface are not coplanar. The method also includes transporting the plate-like element and the card in a direction away from the abutment structure to a printing station and activating the printing station for dot printing on the card.

Further features and advantages will be apparent from the description of a non-exclusive and preferred embodiment of the invention.

BRIEF DESCRIPTION OF THE DRAWINGS

The description is provided for herebelow with reference to the attached drawings, wherein.

DETAILED DESCRIPTION OF THE EMBODIMENTS

Figure 1:
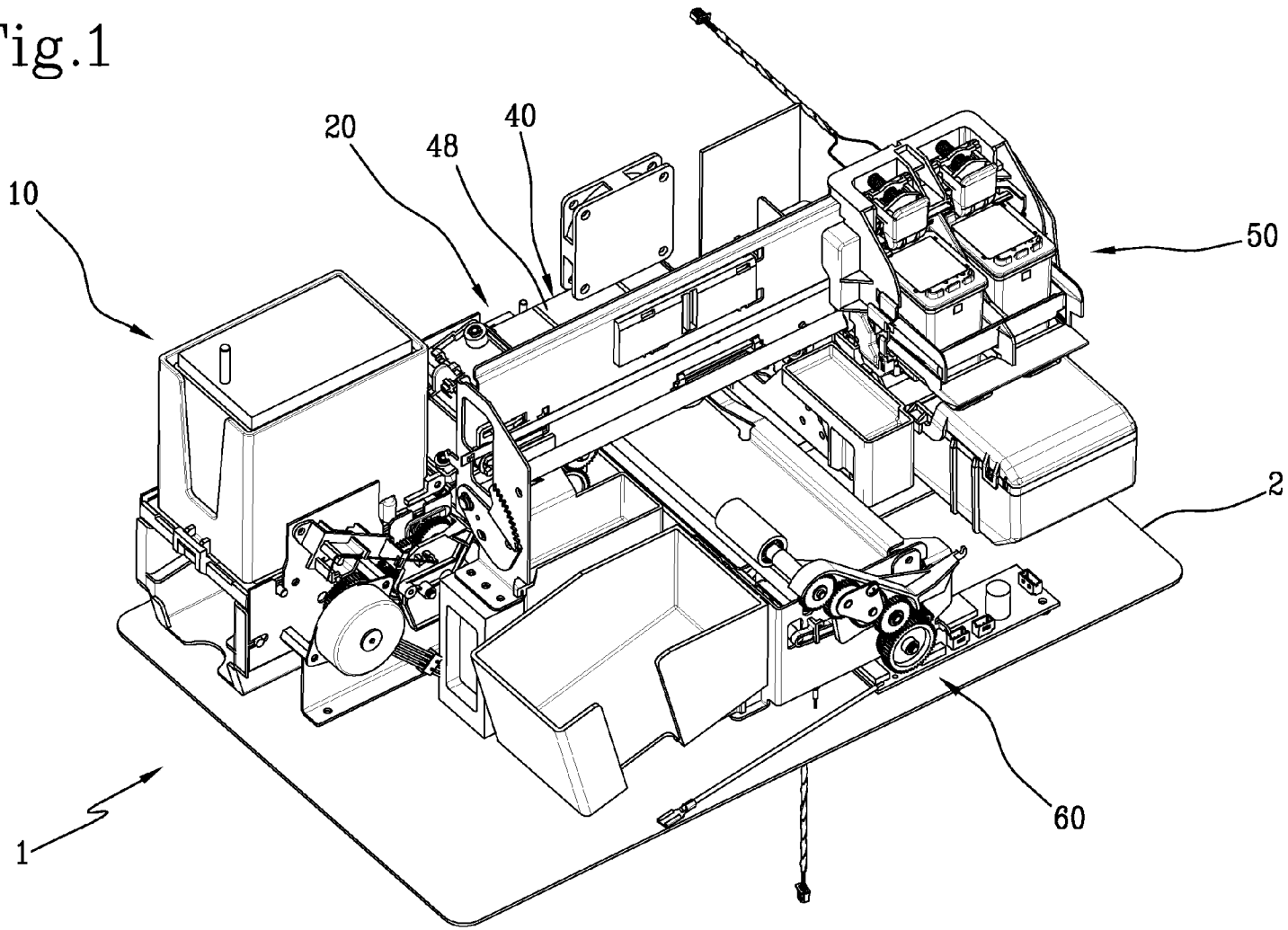
FIG. 1 is a schematic perspective view of a printer by which the method according to the invention can be carried out.

In the attached drawings, reference numeral 1 indicates a dot printer by which the method according to the present invention can be performed.

The method according to the invention is suitable for dot printing on cards like credit cards, smart cards, magnetic cards, etc.

Preferably, the method according to the invention is a method for ink-jet printing on cards.

The printer 1 (FIG. 1) preferably comprises a storage zone 10 wherein one or more cards are stored.

Preferably the cards include, or are made of, a thermoplastic material.

In particular, the thermoplastic material can be selected in the group comprising: polyvinylchloride (PVC); polyvinylchloride (PVC) filled with mineral fillers; laminate polyvinylchloride (PVC); acrylonitrite-butadiene-styrene (ABS) terpolymers; polyethylenterephtalate (PET); glycol containing polyethylenterephtalate (PET-G); polylacticacid (PLA).

The laminate polyvinylchloride is formed by a central layer of polyvinylchloride filled with mineral fillers, and a couple of transparent polyvinylchloride films applied each on a respective surface of the central layer.

Preferably the cards have a substantially plate-like shape, having a substantially rectangular shape in a plan view; the rectangular shape has a larger side and a smaller side.

Preferably the larger side has a length comprised between 80 mm and 90 mm, and in particular substantially equal to 85.7 mm.

Preferably the smaller side has a length comprised between 50 mm and 60 mm, and in particular substantially equal to 54 mm.

Preferably the plate-like shape has a thickness comprised between 0.4 mm and 0.8 mm, and in particular between 0.5 mm and 0.76 mm.

Preferably the printer 1 (FIG. 1) comprises an extraction station or picking station 20 adapted to extract a card 11 (see FIG. 5) from the storage zone 10.

Preferably, the extraction station 20 is provided on a base structure 2, that will be disclosed in detail in the following.

The extraction station 20 picks one card at a time from the storage zone 10 and places it on a support carriage 40.

Figure 2:
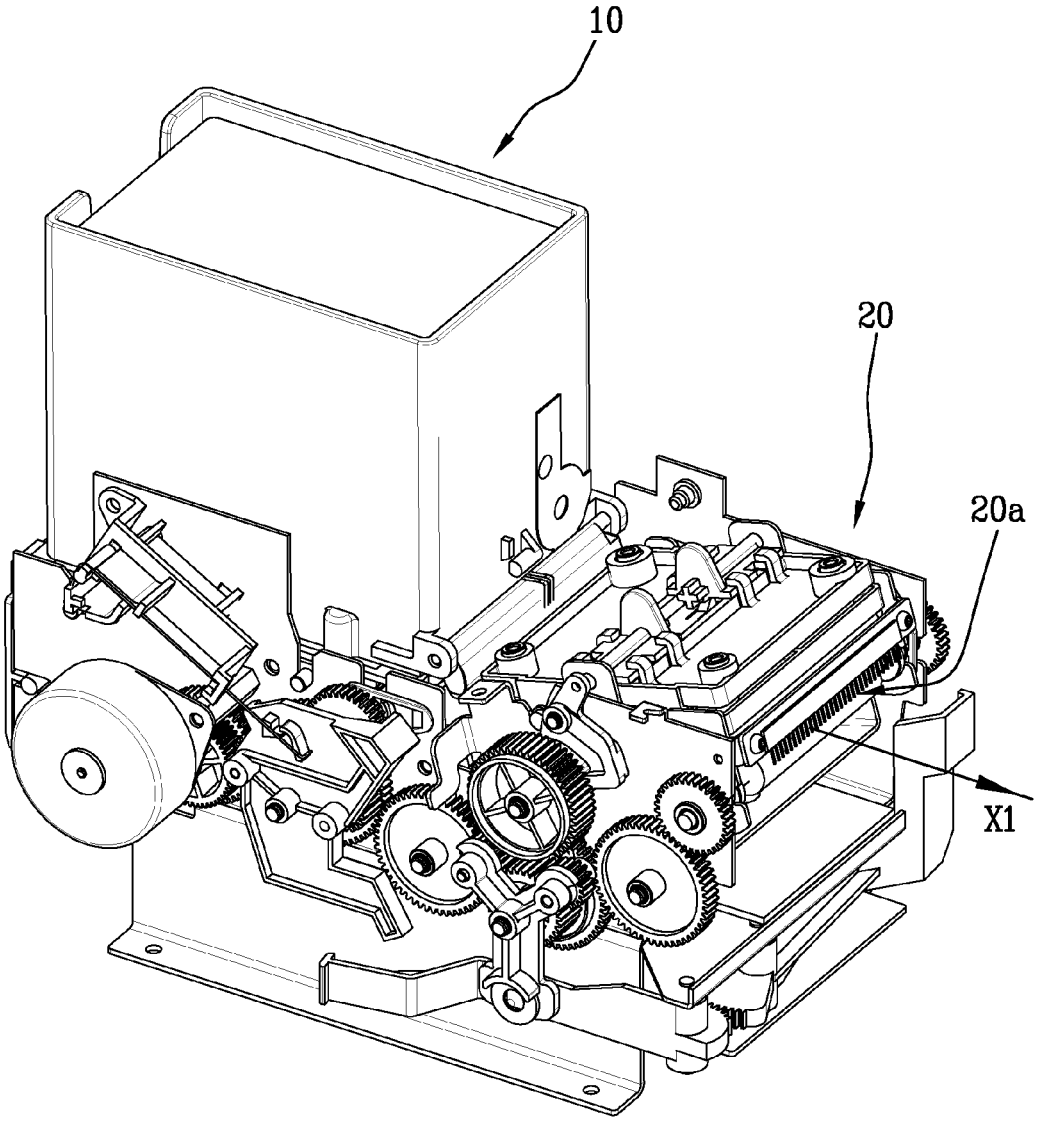
FIGS. 2-5 are schematic perspective views of portions of the printer of FIG. 1.

The extraction station 20 (FIGS. 2, 5) has an output 20*a*, through which the card 11 is output from the extraction station 20.

In a preferred embodiment, the extraction station 20 comprises a plurality of rollers, that act on the card 11 in order to move the same from the storage zone 10 to the output 20*a* of the extraction station 20.

Due to the action of such rollers, the card 11 is placed on a support carriage 40.

The carriage 40 comprises (FIGS. 1, 3) a plate-like element 48, on which the card 11 is positioned.

Preferably, the plate like-element 48 has a shape, in a plan view, similar to that of the card 11.

For example, the plate like-element 48 can have a substantially rectangular shape, having a larger side comprised between 75 mm and 85 mm, and in particular substantially equal to 80 mm, and a smaller side comprised between 45 mm and 55 mm, and in particular substantially equal to 50 mm.

Figure 11A:
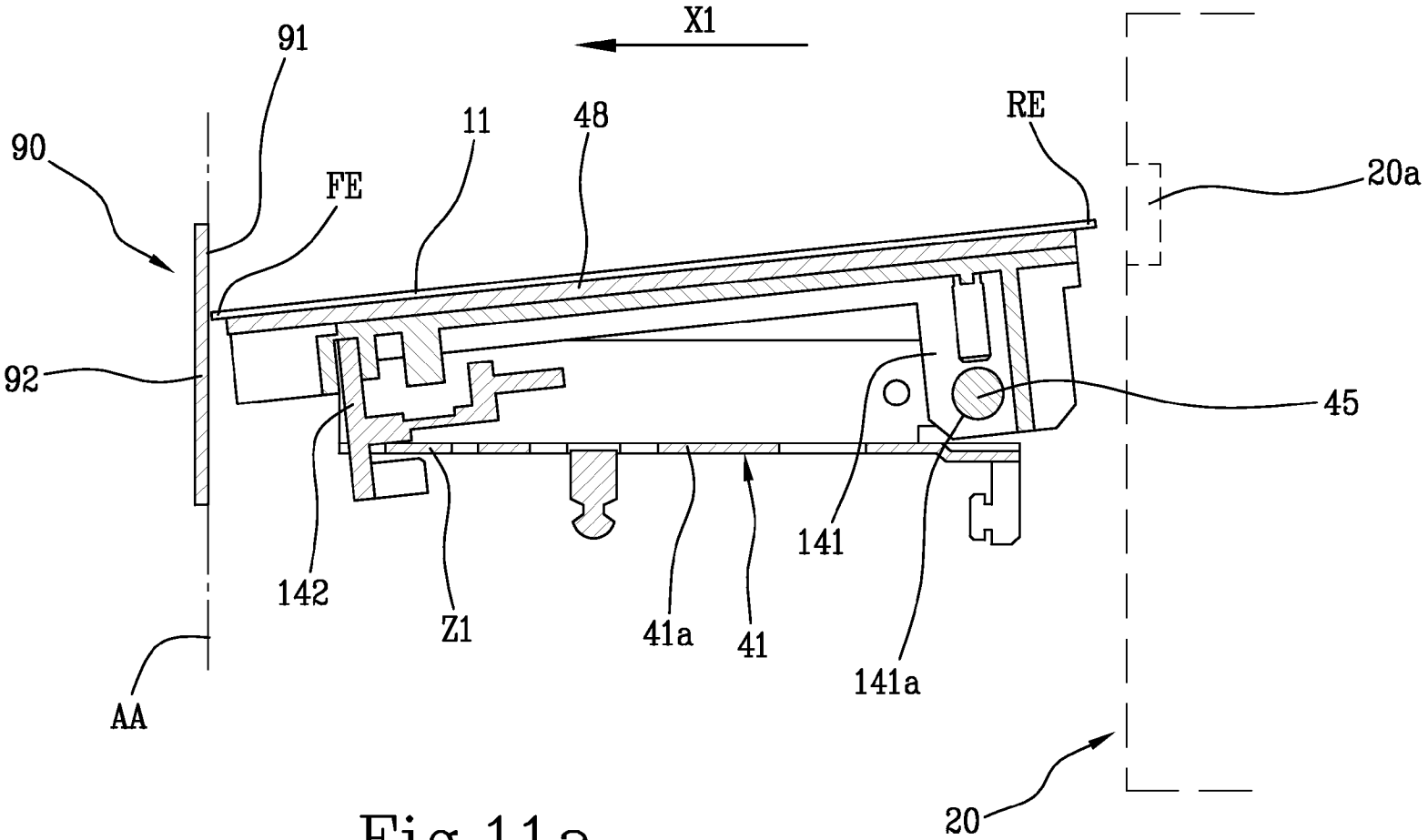
FIGS. 11*a*-11*b* schematically show two different operative configurations of a portion of the printer of FIG. 1.
Figure 11B:
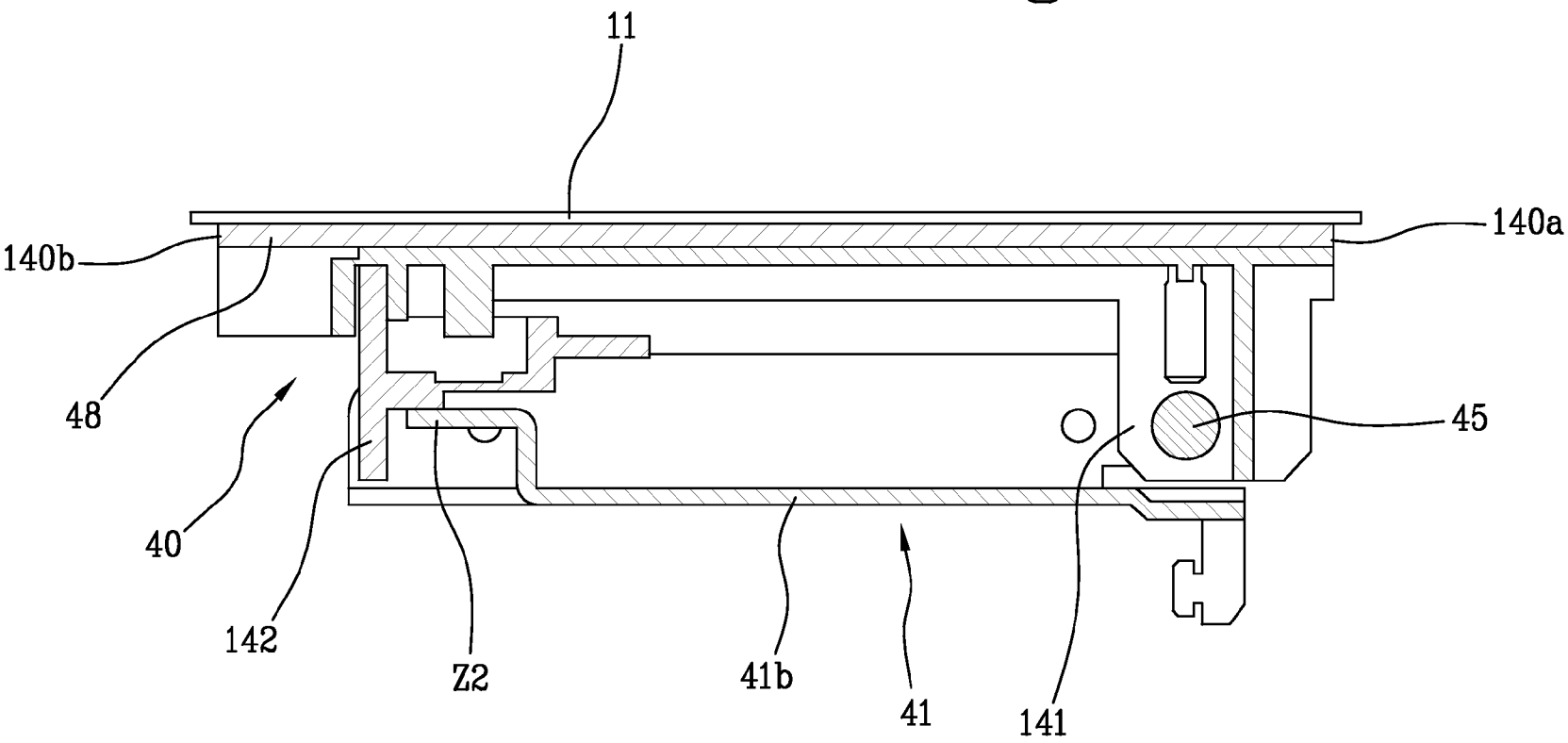

It is to be noted that the card 11 is preferably larger than the plate-like element 48 (see FIGS. 11*a*, 11*b*). Accordingly, the ink used for printing on the card 11 does not reach the plate-like element 48, since the latter is shielded by the card 11. This feature achieves an advantage in that the plate-like element 48 can be, in practice, a printed circuit board (PCB) including a heater for heating the card 11, that would be damaged by an interaction with the ink.

Preferably, the printer 1 comprises a base structure 2, that has a substantially plate-like shape. When the printer 1 is in use condition, the base structure 2 is arranged in a substantially horizontal position, i.e. substantially parallel to the ground.

Preferably the carriage 40 is mounted to and guided by a guide plate 41 (FIGS. 3, 5, 8, 11*a*-11*b*). Preferably, the guide plate 41 is mounted on the base structure 2.

Figure 5:
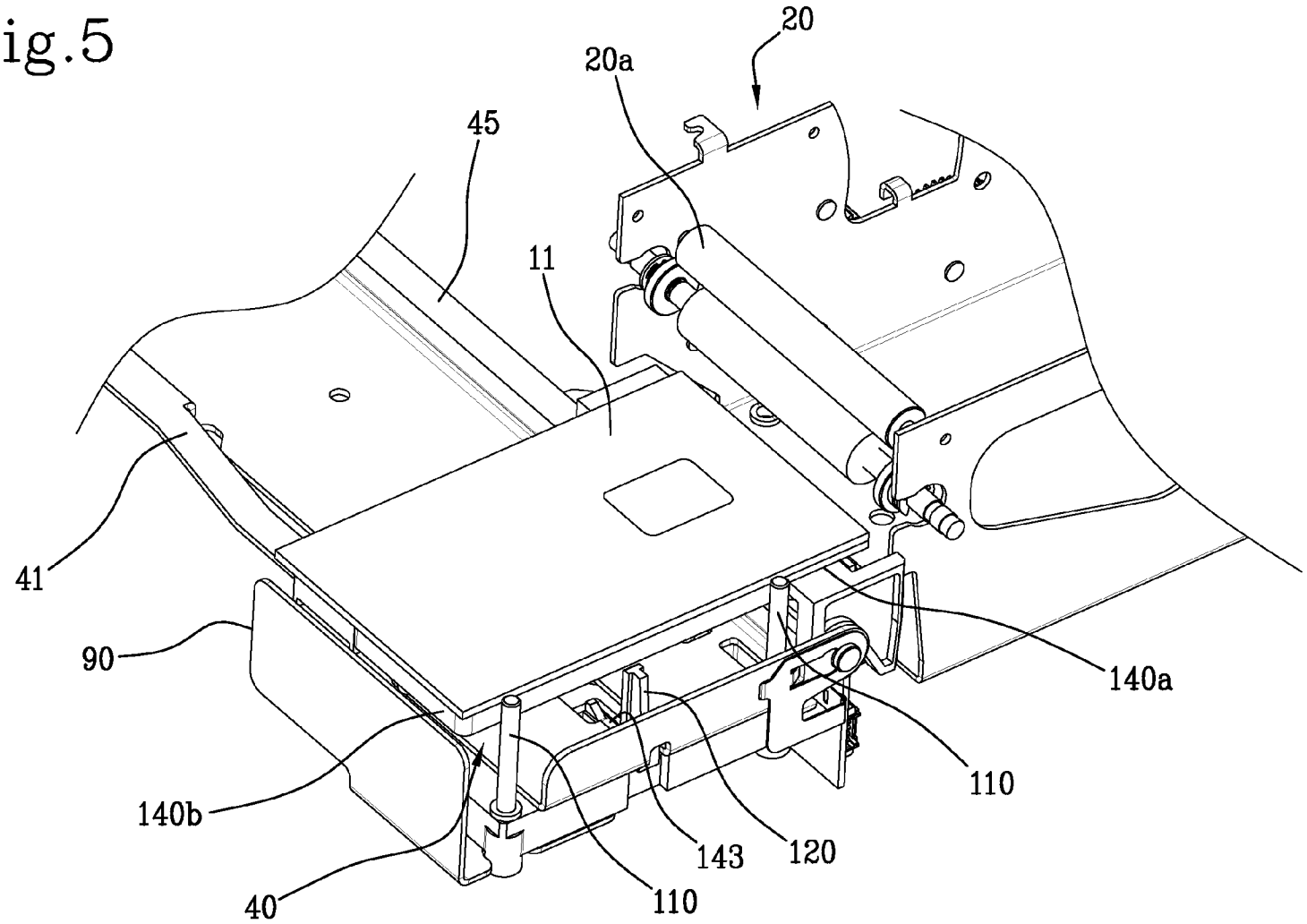

Preferably, the carriage 40 has a first end 140*a* and a second end 140*b* (FIGS. 5, 11*b*). The first end 140*a* is slidably and rotatably mounted with respect to the guide plate 41; in particular the first end 140*a* is slidably and rotatably mounted on a rod 45 fixed to the plate 41 (FIG. 5); the second end 140*b* is slidably mounted on the guide plate 41.

As schematically shown in FIGS. 11*a*-11*b*, the plate-like element 48 is rigidly mounted on a first support element 141 and a second support element 142, that are arranged at the first and second end 140*a*, 140*b* of the carriage 40 respectively.

The first support element 141 has an end rigidly connected with the plate-like element 48.

The first support element 141 has also a through aperture 141*a* for engaging the aforementioned rod 45. Preferably the rod 45 is substantially parallel to the guide plate 41, and has the same longitudinal extension as the guide plate 41.

The second support element 142 has an end rigidly connected with the plate-like element 48, and an opposite end slidably engaged with the guide plate 41.

Figure 3:
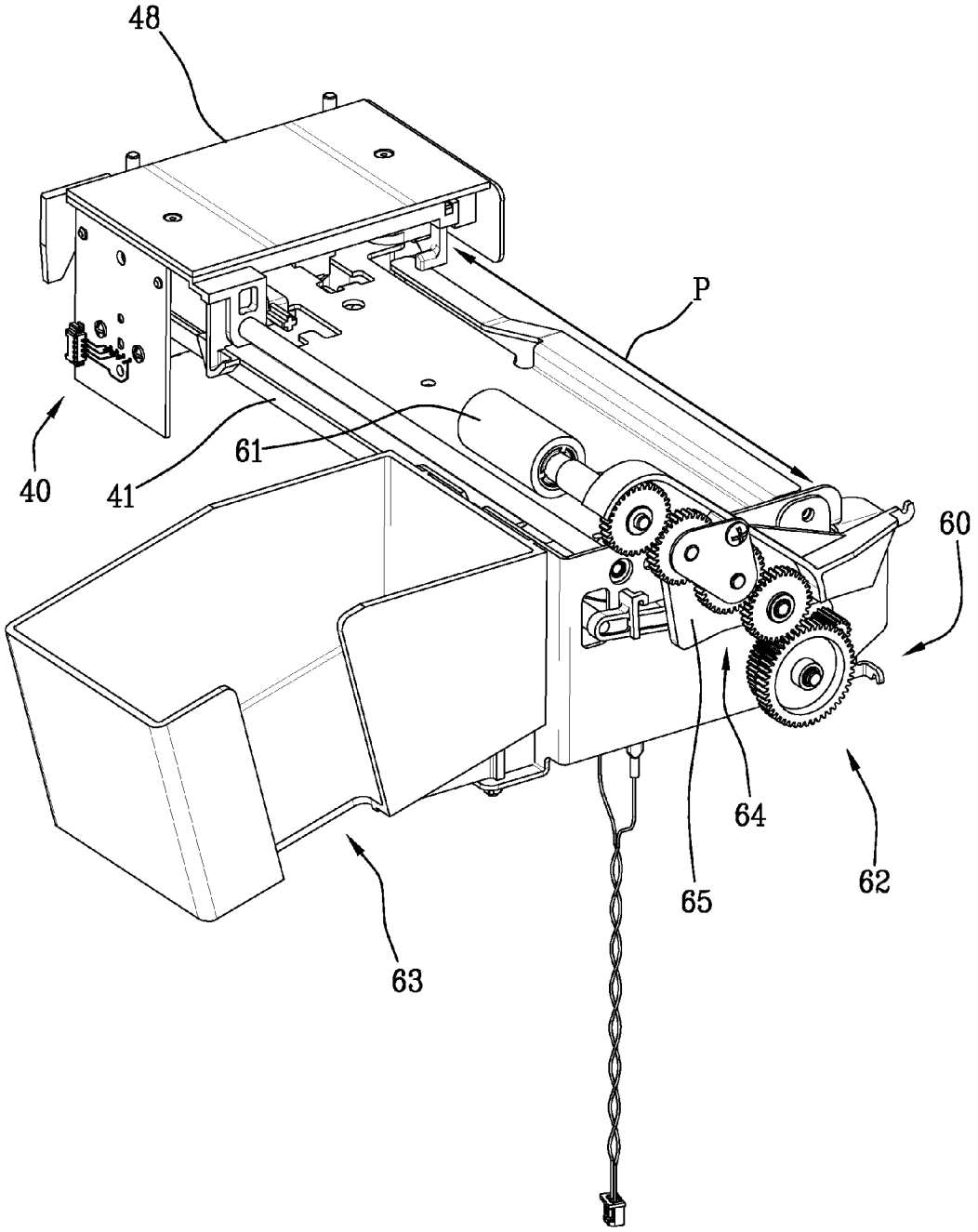
Figure 4:
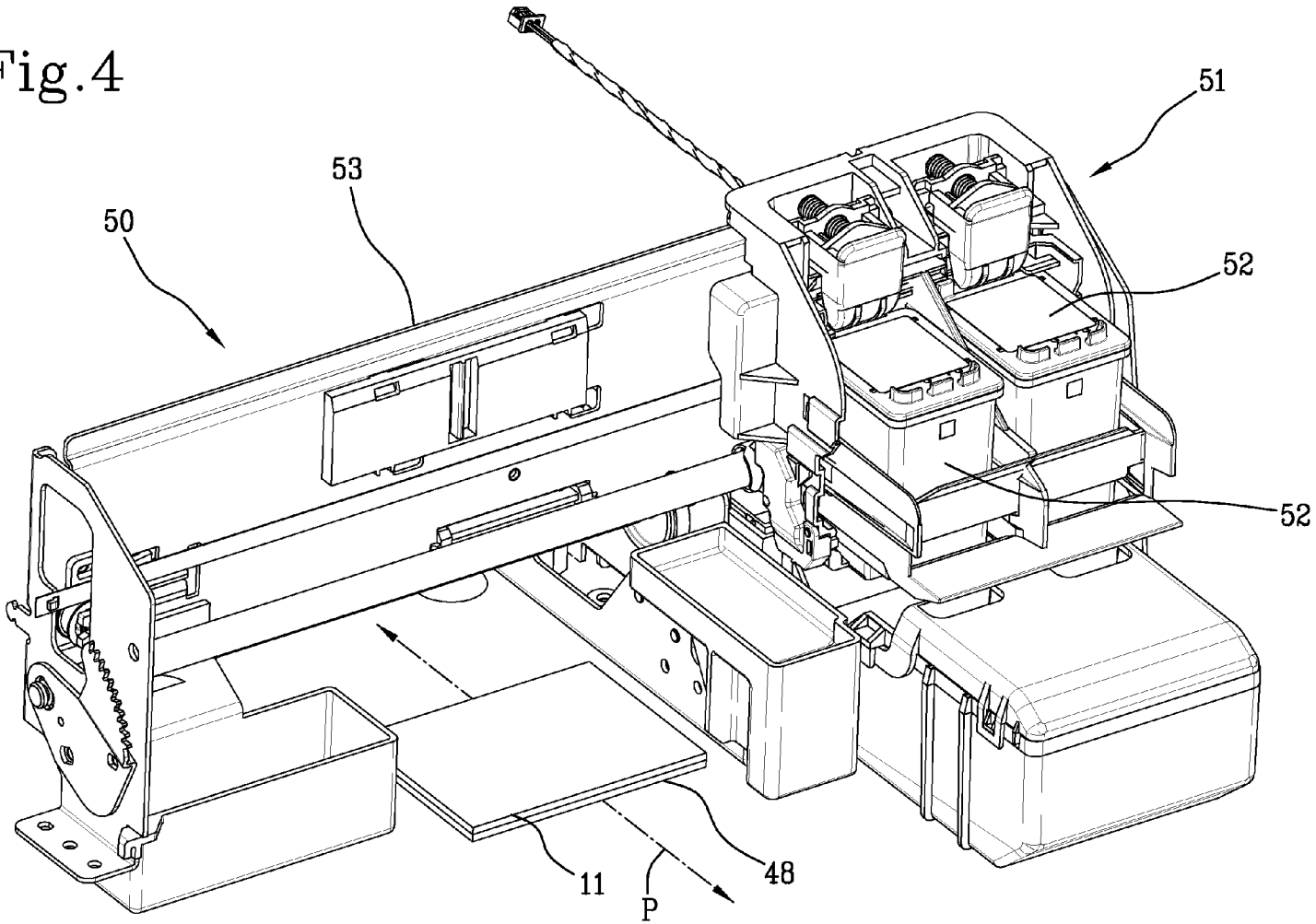

Preferably, the carriage 40 moves on the guide plate 41 along a substantially rectilinear path P (FIGS. 3, 4).

The path P is transverse, and preferably perpendicular, to the direction according to which the card 11 is moved when is it output by the extraction station 20.

With respect to the direction according to which the card 11 is moved when is it output by the extraction station 20, the card 11 has a front end FE and a rear end RE, as schematically shown in FIG. 11*a*.

Preferably the printer 1 comprises an abutment element 90, that faces the output 20*a* of the extraction station 20.

Preferably the abutment element 90 defines a main abutment surface AA for the card 11.

Preferably, the abutment element 90 has a substantially planar surface 91 defining said main abutment surface AA.

In practice, as schematically shown in FIG. 11*a*, the abutment element 90 can be a planar element 92.

For example, the planar element 92 can be a plate-like wall, 50 mm to 56 mm wide, 30 mm to 32 mm long, 0.8 mm to 1.2 mm thick.

The printer 1 further comprises an abutment structure 100, comprising a first abutment portion 110 and a second abutment portion 120 (FIGS. 5, 9, 10*a*-10*c*).

The first abutment portion 110 defines a first abutment surface A1 for the card 11. The second abutment portion 120 defines a second abutment surface A2 for the carriage 40.

The first abutment surface A1 is parallel to the second abutment surface A2 and offset from said second abutment surface A2 by a first distance d1.

Preferably the main abutment surface AA is transverse, and in particular perpendicular, to the first and second abutment surfaces A1, A2.

Preferably the first abutment surface A1 is a substantially planar surface.

Preferably the second abutment surface A2 is a substantially planar surface.

Preferably the main abutment surface AA is a substantially planar surface.

Preferably, the abutment structure 100 comprises a base portion 130, to which the first and second abutment portions 110, 120 are integrally mounted.

In a preferred embodiment, the first abutment portion 110 extends from the base portion 130 by a first height h1, and the second abutment portion 120 extends from the base portion 130 by a second height h2.

Figure 10:
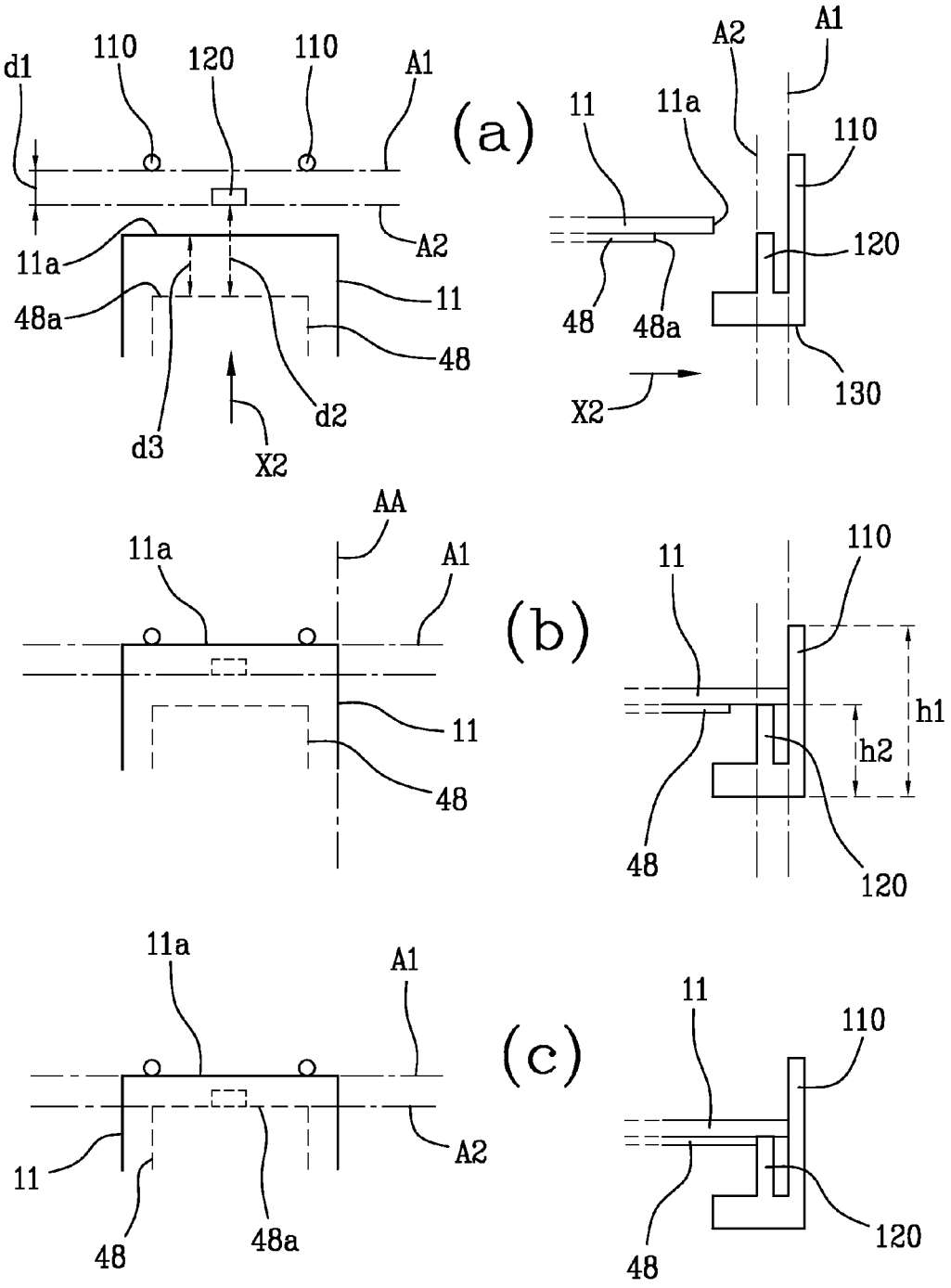
FIGS. 10*a*-10*c* schematically show a succession of operative conditions of the printer of FIG. 1.

Preferably, the first height h1 is larger than the second height h2 (FIG. 10*b*).

Figure 9:
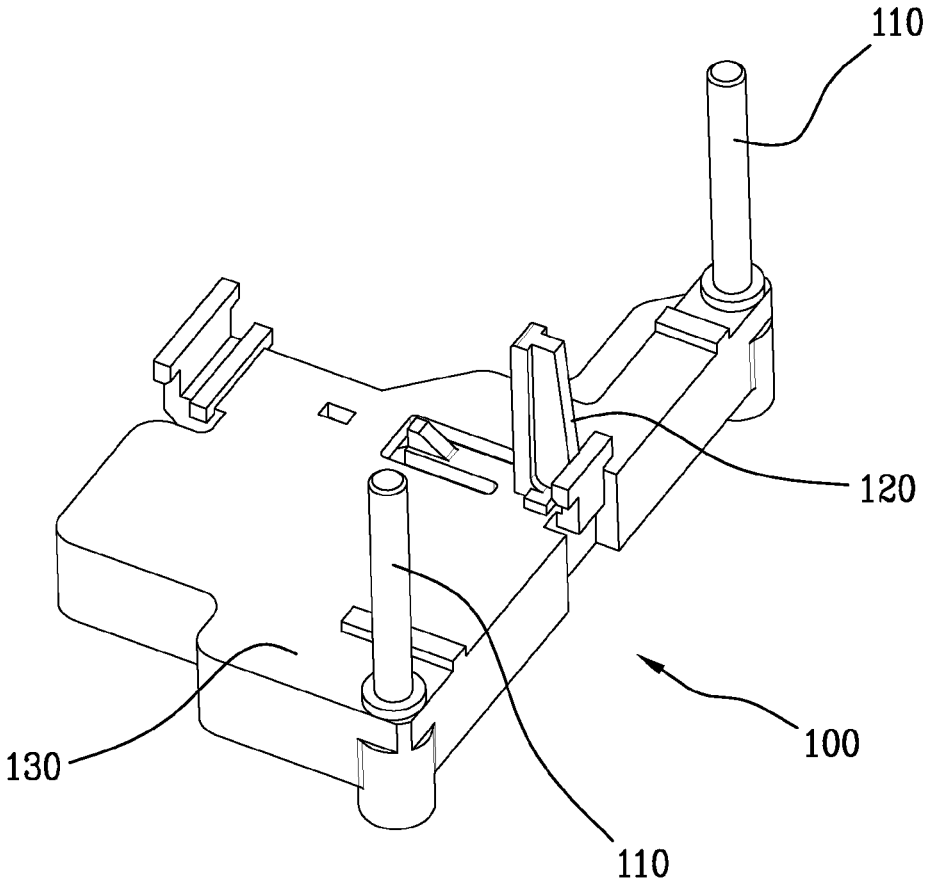

Preferably, the base portion 130 is a substantially planar element, as schematically shown in FIG. 9.

Preferably, the abutment element 90 and the abutment structure 100 are integral with each other, as schematically shown in FIG. 5.

As schematically shown in FIGS. 5 and 9, the first abutment portion 110 can comprise a couple of pins, protruding from the base portion 130.

In order to receive the card 11, the support carriage 40 is in a first position P1 (FIGS. 6, 10*a*, 11*a*), immediately downstream with respect to the output 20*a* of the extraction station 20.

In particular, in the first position P1, the carriage 40 is interposed between the output 20*a* of the extraction station 20 and the abutment element 90.

Preferably, in the first position P1, two sides of the plate-like element 48 are substantially parallel to the direction according to which the card 11 is moved when it is output by the extraction station 20.

Preferably, in the first position P1, the other two sides of the plate-like element 48 are substantially parallel to the main abutment surface AA.

In a preferred embodiment, the longer sides of the plate-like element 48 are parallel to the output direction of the extraction station 20, whereas the shorter sides of the plate-like element 48 are parallel to the main abutment surface AA.

Preferably, in the first position P1, the carriage 40 is arranged side-by-side with the abutment structure 100.

Preferably when the carriage 40 is in the first position P1, it is closer to the second abutment portion 120 than to the first abutment portion 110.

Preferably, the plate-like element 48 has a main edge 48*a* (FIG. 10*a*) that has a second distance d2 from the second abutment portion 120 that is larger than the first distance d1, i.e. the distance between the first and second abutment surfaces A1, A2.

Preferably, the main edge 48*a* of the plate-like element 48 is substantially rectilinear.

In the preferred embodiment, the main edge 48*a* is one of the longer sides of the plate-like element 48, and in particular the one that is closer to the abutment structure 100.

Preferably, the abutment structure 100 is so arranged that the first and second abutment surfaces A1, A2 are substantially parallel to the output direction of the extraction station 20, i.e. the direction in which the card 11 is moved when it is output by the extraction station 20.

When the carriage 40 is in the first position P1, it can receive the card 11 from the extraction station 20.

In particular, the card 11 is placed on the plate-like element 48 so that the card 11 extends partly beyond the main edge 48*a*, and a main side 11*a* of the card 11 has a third distance d3 from the main edge 48*a* that is larger than said first distance d1.

Preferably, the main side 11*a* of the card 11 is substantially rectilinear.

As schematically shown in FIG. 10*a*, a portion of the card 11 is not in contact with the plate-like element 48; such portion is delimited, on one side, by the main side 11*a* of the card 11.

In a preferred embodiment, wherein the card 11 has a substantially rectangular shape, the main side 11*a* is one of the longer sides of the rectangular shape.

Preferably, when the carriage 40 is in the first position P1, the plate-like element 48 is in a tilted condition (FIG. 11*a*), i.e. tilted towards the abutment element 90; in other words, the plate-like element 48 has a larger height, with respect to the base structure 2, at its end facing the output 20*a* of said extraction station 20, than at its end facing the abutment element 90.

Preferably, the higher end of the plate-like element 48 is close to the first end 140*a* of the carriage 40, and the lower end is close to the second end 140*b* of the carriage 40.

Preferably, the tilted condition is due to the shape of the guide plate 41 and that of the support elements 141, 142.

In fact, in a preferred embodiment, the guide plate 41 is so shaped that when the carriage 40 is in its first position P1, the plate like element 48 is in the tilted condition.

In particular, the guide plate 41 (FIG. 8) has a first portion 41*a* interposed between the output 20*a* of the extraction station 20 and the abutment element 90, and at least a second portion 41*b* at a printing station 50, wherein printing on the card 11 can be performed.

Preferably the first portion 41*a* of the guide plate 41 is substantially homogeneously planar, i.e. all its parts are arranged at the same height with respect to the base structure 2.

The first and the second support elements 141, 142 have different heights, i.e. maintain the respective ends 140*a*, 140*b* of the carriage 40 at different heights with respect to the base structure 2 when the carriage 40 is in the first position P1.

In particular, the second support element 142 is shorter than the first support element 141.

A schematic representation of the carriage 40 in the first position P1 is shown in FIGS. 10*a* and 11*a*.

As schematically shown in FIG. 11*a*, the second support element 142 is in abutment with a first zone Z1 of the first portion 41*a* of the guide plate 41.

In view of the above, due to the action of the rollers belonging to the extraction station 20 and the tilted condition of the plate-like element 48, the card 11 is moved in a first direction X1 to reach the abutment element 90, so that the front end FE of the card 11 is in abutment with the abutment element 90.

In a preferred embodiment, the first direction X1 is substantially parallel to the longer sides of the card 11, and the front end FE of the card 11 is one of the shorter sides.

Preferably, the main abutment surface AA is the surface substantially perpendicular to the base structure 2 and including the front end FE of the card 11 when the latter is in abutment with the abutment element 90.

Then the method according to the invention comprises a step of performing a first movement, in a second direction X2, of the carriage 40 towards the abutment structure 100 (FIG. 10*a*).

Preferably, the second direction X2 is transverse, and more preferably perpendicular, to the first direction X1.

Following the first movement of the carriage 40, first the main side 11*a* of the card 11 impinges on the first abutment portion 110 and stops at the first abutment surface A1 (FIG. 10*b*).

Then the main edge 48*a* of the plate-like element 48 impinges on the second abutment portion 120 and reaches the second abutment surface A2 (FIG. 10*c*).

In more detail, in the first movement of the carriage 40, the latter and the card 11 are initially moved together along the second direction X2, until the card 11 stops at the first abutment surface A1. Then the carriage 40 continues the movement in the second direction X2, while the card 11 is maintained still by the first abutment portion 110, until the main edge 48*a* of the plate-like element 48 reaches the second abutment portion 120.

In practice, during the second part of the first movement, the carriage 40 slides beneath the card 11.

When the first movement is completed, the mutual positioning of the card 11 and the carriage 40, i.e. the plate-like element 48, is mechanically established by the abutment element 90 (along the first direction X1), and by the abutment structure 100 (along the second direction X2).

Preferably, the first abutment surface A1 is a plane substantially perpendicular to the base structure 2 and that includes the main side 11*a* of the card 11 when the latter is in abutment with the first abutment portion 110.

Preferably, the second abutment surface A2 is a plane substantially perpendicular to the base structure 2 and that includes the main edge 48*a* of the plate-like element 48 when the latter is in abutment with the second abutment portion 120.

Preferably, while the first movement of the carriage 40 is performed, the card 11, and in particular the front end FE thereof, is kept in abutment with the abutment element 90, so that the mutual positioning of the card 11 and the plate-like element 48 along the first direction X1 is maintained while the mutual positioning along the second direction X2 is achieved.

Preferably, after the main edge 48*a* of the plate-like element 48 has impinged on the second abutment portion 120, the method further comprising a step of performing a second movement of the carriage 40 in the second direction X2 for a preset additional path.

This ensures optimal abutment of the carriage 40 and the card 11 with the abutment structure 100.

Preferably, the abutment structure 100 is slidingly and resiliently coupled to the frame of the printer 1, and in particular to the guide element 41.

Preferably, the abutment structure 100 is slidingly engaged with a slot 143 of the guide element 41 (FIG. 5).

A resilient member, such as a spring, for example (not shown) is active on the abutment structure 100 so as to allow movement of the abutment structure 100 between a first position, wherein it receives the card 11 and the carriage 40, and a second position, reached after performing said preset additional path, which is the actual end of stroke. After the carriage 40 has moved to the printing station 50, the abutment structure 100 is brought back to the first position by the resilient member.

For example, the preset additional path can be 20 mm to 30 mm long.

The method according to the invention further comprises performing a main movement of the carriage 40 for bringing the card 11 to the printing station 50.

Preferably, the main movement is performed after the first movement, and in particular after the second movement.

The main movement is performed along the rectilinear path P of the carriage 40 on the guide plate 41, in a direction opposite to the second direction X2.

In other terms, the main movement causes the carriage 40 to move away from the abutment structure 100.

The main movement brings the carriage 40 in a second position P2, wherein the card 11 card undergoes a printing process by the printing station 50.

Preferably, when the carriage 40 is in its second position P2, the plate-like element 48 is substantially parallel to the base structure 2.

Preferably, when the carriage 40 is in its second position P2, it is at the second portion 41*b* of the guide element 41.

In particular, when the carriage 40 is in its second position P2, the plate-like element 48 is substantially parallel to the second portion 41*b* of the guide plate 41 (FIG. 11*b*).

The second portion 41*b* of the guide plate 41 includes a second zone Z2, which the second support element 142 is in abutment with when the carriage 40 is in the second position P2.

The second zone Z2 is arranged at a higher height than the first zone Z1 with respect to the base structure 2.

When the carriage 40 is in the second position P2, the rod 45 supports the first support element 141, and the second zone Z2 supports the second support element 142.

Preferably, the difference in height between the second zone Z2 and the remaining part of the second portion 41*b* of the guide plate 41 is substantially equal to the difference in length between the first and the second support elements 141, 142. Likewise, as mentioned above, when the carriage 40 is in the second position P2, the plate-like element 48 is substantially horizontal, i.e. substantially parallel to the base structure 2.

Preferably, the guide plate 41 comprises a transition zone TZ (FIG. 8), interposed between the first zone Z1 and the second zone Z2, so that the height with respect to the base structure 2 gradually changes.

For example, the height difference between the first zone Z1 and the second zone Z2 is comprised between 10 mm and 15 mm.

For example, the length of the transition zone TZ, determined on a plane parallel to the base structure 2, is comprised between 30 mm and 35 mm.

The printing station 50 is then activated for dot printing on the card 11.

Preferably, the printing station 50 is configured for ink jet printing.

In particular, the printing station 50 (FIG. 4) comprises at least an ink jet printhead 51 for ink-jet printing on the card 11.

The printhead 51 is provided with at least a reservoir 52 containing ink. Said ink comprises:

- a medium, or vehicle, consisting of a low-boiling organic solvent;
- an auxiliary solvent consisting of a high-boiling organic solvent;
- a coloring component soluble in said medium or vehicle.

In this context and in the following claims, the term "soluble" indicates solubility of at least 10% w/w.

Preferably the vehicle has a boiling temperature lower than 120° C. and in particular lower than 80° C.

Preferably the vehicle is selected in the group of alcohols.

For example, the vehicle can be ethanol, n-propanol, n-butanol.

The vehicle has the tasks of dissolving the various components of the ink and sustaining the formation of the ink bubbles.

Preferably the auxiliary solvent has a boiling temperature higher than 120° C. and in particular higher than 150° C.

Preferably the auxiliary solvent is able to dissolve or to swell the plastic materials, and in particular the thermoplastic material of which the cards are made.

Preferably the auxiliary solvent is soluble in the vehicle.

For example, the auxiliary solvent can be selected in the group comprising: N-methyl-2-pyrrolidone, N-ethyl-2-pyrrolidone, 1,3-dimethyl-imidazolidinone, ϵ-caprolactone, γ_butyrolactone; glycol ethers like: ethylene glycol monomethyl ether, diethylene glycol monobutyl ether, triethylene glycol monomethyl ether, esters like: ethyl lactate, ethyl acetate; or mixtures thereof.

Preferably, the coloring components belongs to the so called Solvent family according to the Color Index terminology.

Preferably the coloring component is a substance that is capable of dissolving in the plastic material of which the cards are made, so as to become integral with the cards and to obtain an optimal printing.

For example, the coloring component can be selected in the group comprising: solvent black 29, solvent black 27; solvent blue 67, solvent blue 44, solvent blue 70; solvent yellow 82, solvent yellow 88; solvent red 125, solvent red 122.

Preferably, the ink also comprises one or more additives such as, for example, levelling agents, in order to improve the uniformity of the distribution of the ink on the cards.

For example, such additives can include silicon derivatives.

In the preferred embodiment schematically shown in FIG. 4, the printhead 51 is provided with two reservoirs 52.

The printing station 50 comprises a driving system (not shown) adapted to move the printhead 51 back and forth, along a preset path, so that the printhead 51 can eject ink on the card 11 during a sequence of steps regulated by a properly configured regulation unit.

Preferably the printhead 51 is slidably mounted on a support plate 53. In a preferred embodiment, the support plate 53 is transverse, and preferably perpendicular, to the path P of the carriage 40.

Figure 7:
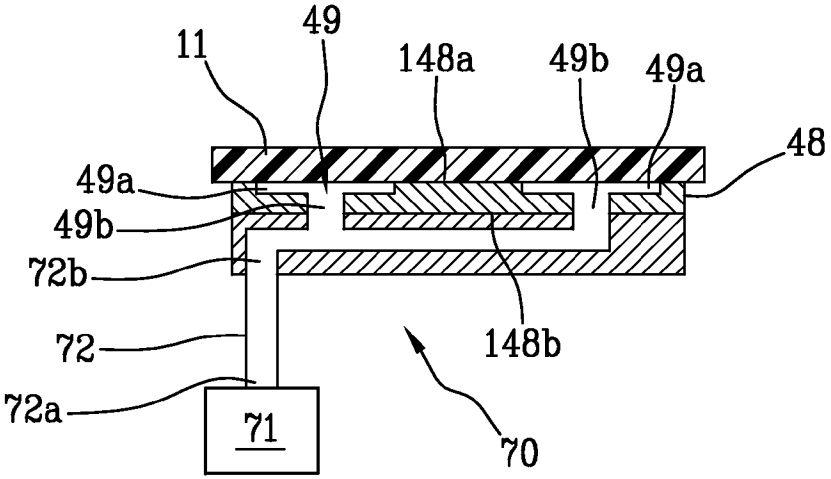
FIG. 7 is a schematic cross section view of portion of the printer of FIG. 1.
Figure 8:
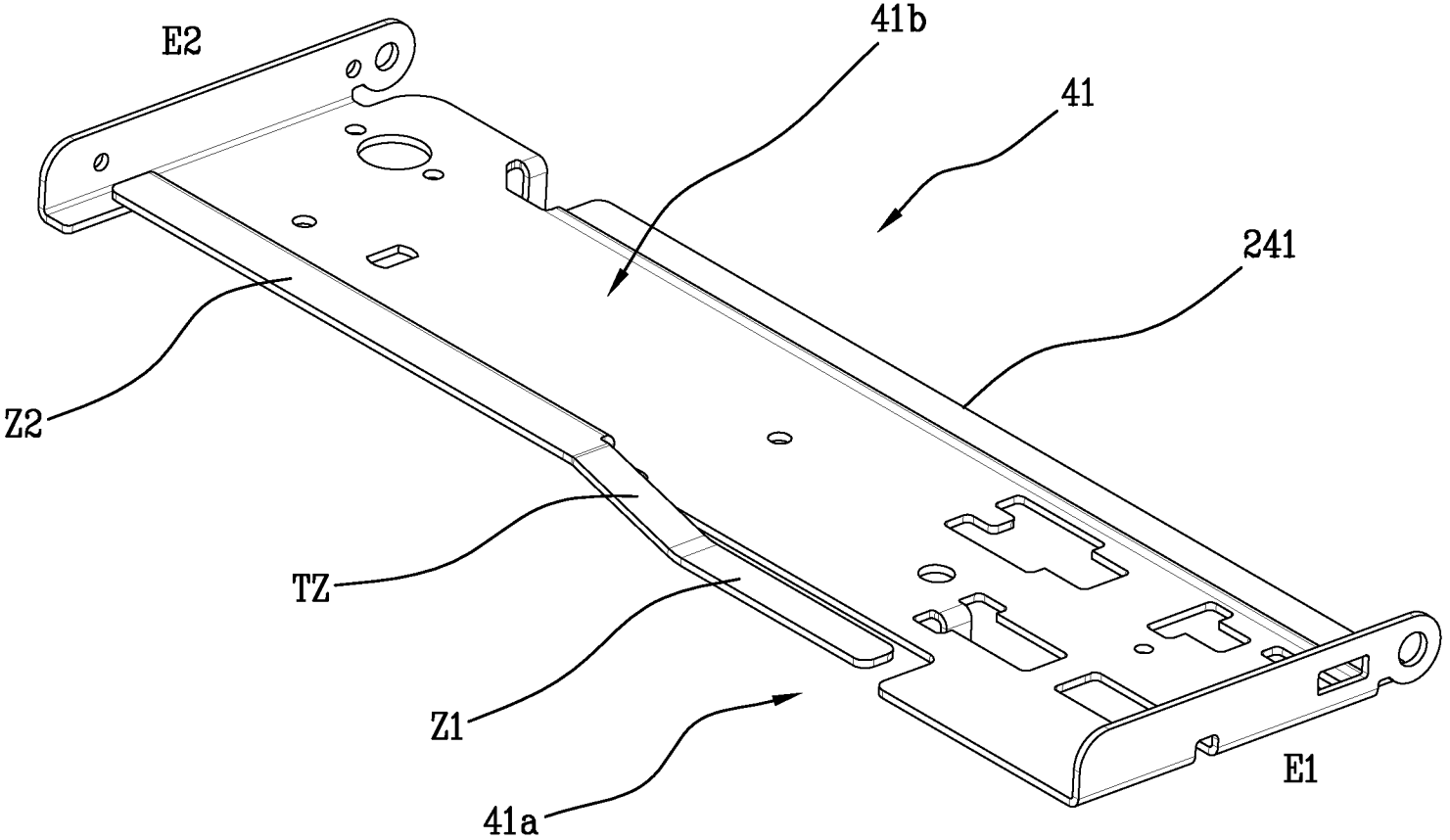
FIGS. 8 and 9 are schematic perspective views of details of the printer of FIG. 1.

Preferably, in order to secure the card 11 to the plate-like element 48, the printer 1 comprises a suction system 70 (FIG. 7).

Preferably, the suction system 70 comprises a pump 71, and at least a conduit 72.

The conduit 72 has a first end 72*a* and a second end 72*b*.

The first end 72*a* is connected with the pump 71.

The second end 72*b* is engaged with the plate-like element 48 of the carriage 40.

Preferably the plate-like element 48 has one or more through holes 49 for allowing said suction 70 system to act on said card 11.

In practice, the suction action generated by the pump 71 is transmitted to the card 11 through the conduit 72 and the one or more through holes 49 of the plate-like element 48.

Preferably one or more of the one or more through holes 49 have a first portion 49*a* and a second portion 49*b*.

The first portion 49*a* ends on the first surface 148*a* of the plate-like element 48. The first portion 49*a* has a cross-section, on a first plane substantially parallel to the planar extension of the plate-like element 48. Such cross-section is referred to as "first cross-section".

The second portion 49*b* ends on the second surface 148*b* of the plate-like element 48. The second portion 49*b* has a cross-section, on a second plane having the same position as (i.e. being distinct from and parallel to) said first plane. Such cross-section is referred to as "second cross-section".

Preferably, the first cross-section is larger than the second cross-section. Advantageously, this improves the suction engagement between the card 11 and the plate-like element 48.

The suction system 70 is particularly advantageous in order to obtain the so-called "borderless printing", i.e. a printing wherein 100% of the card's surface can be actually used.

In fact, by employing the above cited suction system 70, no further grabbing/picking/handling members are necessary, that would be at least partly interposed between the printhead and the card's surface during the printing operation, thereby preventing the ink to reach the whole surface of the card.

Preferably, the suction system 70 is activated after completion of the first movement, and in particular after completion of the second movement.

Preferably, the suction system 70 is activated before carrying out the main movement.

Preferably, the suction system 70 is maintained active along all the printing process by the printing station 50.

Preferably, the main movement, the first movement and the second movement of said carriage 40 are performed moving the carriage 40 on the guide plate 41.

Preferably, the above mentioned first position P1 and second position P2 are defined on the guide plate 41.

In order to move the carriage 40 along its path P, the printer 1 comprises a driving motor.

Preferably, the driving motor is mounted to and integral with the base structure 2 of the printer 1.

Preferably, the driving motor is mounted at an end E1, E2 of the guide plate 41. End E1 is the one closer to the output 20*a* of the extraction station 20.

More preferably, the driving motor is mounted at the second end E2 of the guide plate 41.

Preferably, the driving motor is connected to the carriage 40 by a mechanism comprising a pulley and a belt. The pulley is force fitted on the motor output shaft. The belt is engaged with the pulley and fixed onto the carriage 40.

The carriage 40 is also subject to the action of a resilient member, slidably mounted on the guide plate 41.

Preferably the resilient member comprises an auxiliary pulley and a spring. The auxiliary pulley is engaged with the belt. The spring has a first end engaged with the guide plate 41, and a second end, opposite to said first end, engaged with the auxiliary pulley through a support member.

The resilient member acts along the movement direction of the carriage 40 (i.e. the direction of path P) and, in cooperation with the driving motor, contributes to defining the movement of the carriage 40.

Figure 6:
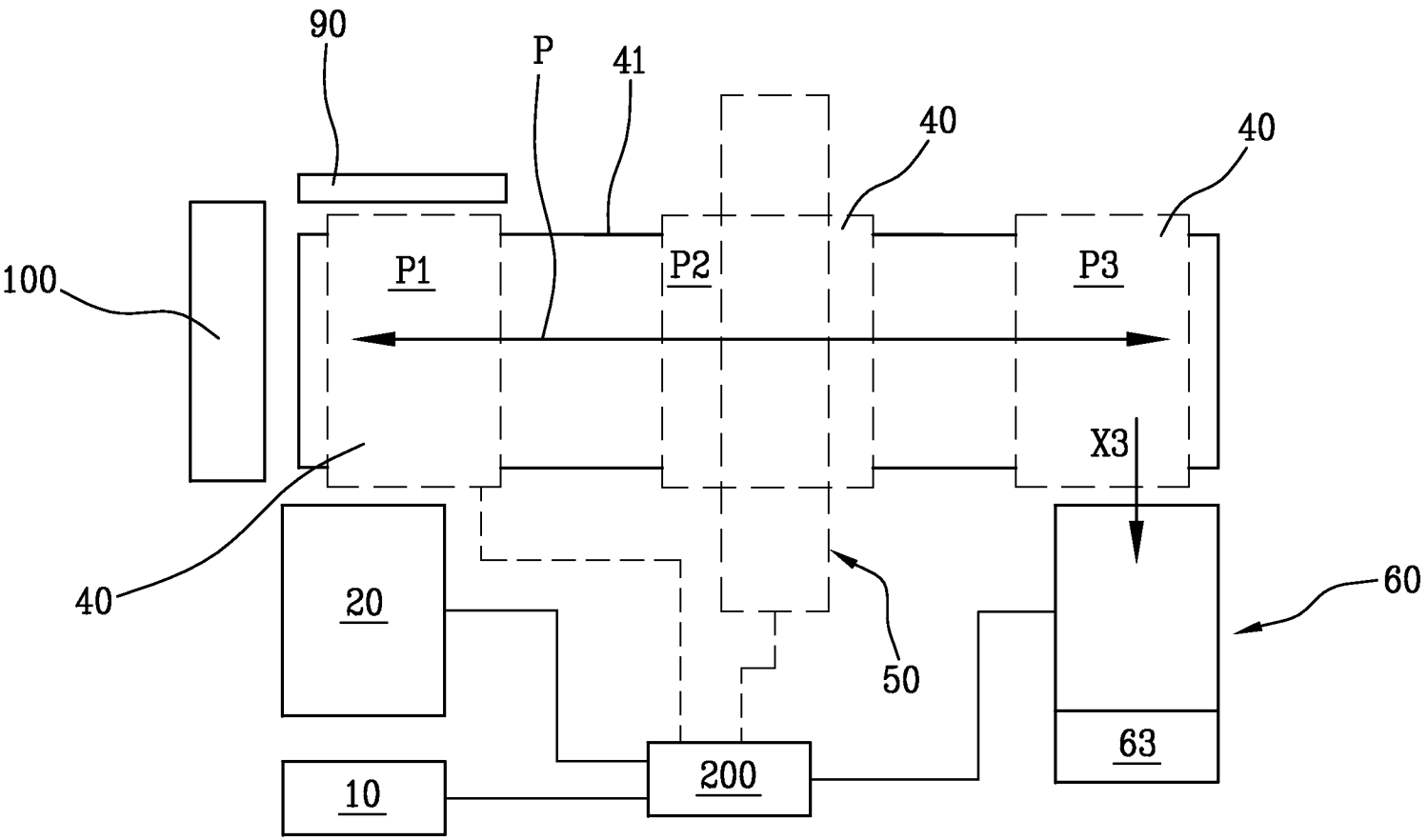
FIG. 6 is a schematic diagram showing possible operative configurations of the printer of claim 1.

Preferably, the method according to the invention further comprises performing a third movement of the carriage 40, from the second position P2 to a third position P3 (FIG. 6). The third position P3 is substantially at the second end E2 of the guide plate 51. Thus, the second position P2 is preferably interposed between the first position P1 and the third position P3 along the path P.

When the carriage 40 is in the third position P3, the card 11 can be subject to the action of an ejection station 60. The ejection station is configured to move the card 11 away from the carriage 40 and, preferably, to make it land into a container 63.

As schematically shown in FIG. 3, the ejection station 60 comprises an ejection roller 61 activated by an activation mechanism 62.

In use, the ejection roller 61 is in contact with the upper surface of the card 11 and, rotating, acts on the card in order to eject the same.

Preferably the activation mechanism 62 is driven by an electro-mechanical actuator, such as an electric motor.

The activation mechanism 62 can comprise a suitable kinematic chain 64 that transfers the rotation of said electric motor to the ejection roller 61.

In a preferred embodiment, the ejection roller 61 and at least a part of the activation mechanism 62 are mounted on a movable plate 65, pivoted to a frame mounted on the base structure 2 of the printer 1. The movable plate 65 can be driven between a lower position, wherein it is in contact with the card 11 so as to move the same, and an upper position, wherein it allows the card 11 to reach the ejection station 60 after the printing operation.

Preferably, the suction system 70 is maintained active until the third movement is completed.

Preferably, the suction system 70 is switched-off after completion of the third movement, before the ejection station 60 is activated.

Preferably, the ejection station 60 act along an ejection direction X3, that is transverse, and preferably perpendicular, to the path P of the carriage 40.

In the preferred embodiment, the ejection direction is substantially parallel to the first direction X1.

In particular, the rotation axis of the ejection roller 61 is advantageously parallel with respect to the path P, so as to eject the card 11 along a direction substantially perpendicular with respect to the same path P.

In view of the above, the printer 1 can have a substantially "C"-shaped structure, that is schematically shown in FIG. 6. This "C"-shaped structure comprises: the storage zone 10, the extraction station 20, the guide plate 41, the ejection station 60, and the container 63.

The printer 1 preferably comprises a control system 200 (schematically shown in FIG. 6) configured for making the extraction station 20, the carriage 40, the printing station 50, the extraction station 60 carry out the functions described above.

The control system 200 may comprise an electronic processor, programmed so as to manage the working of the printer 1 and components thereof.

The control system 200 may further comprise actuators and mechanical connections associated to said processor and properly arranged so as to allow performing of said operations.

Advantageously the control system 200 may further comprise one or more sensors adapted to provide the electronic processor with parameters and data representative of operative conditions of the printer, so that said processor is able to determine the proper action to be undertaken.

The invention achieves important advantages.

The method according to the invention allows a proper positioning of the card with respect to the printing station that executes the printing process.

Another advantage consists in that the card to be printed is positioned on the support carriage in a simple and quick manner.

Another advantage consists in that the printer by means of which the method according to the invention is carried out is characterized by a simple structure and reduced overall dimensions.

The invention claimed is:

1. A method for dot printing on cards comprising:

activating an extraction station to move a card in a first direction toward an abutment element facing an output of the extraction device in order to place the card on a support carriage, the card having at least a main side and the support carriage including at least a plate-like element for supporting the card and the plate-like element having at least a main edge;

positioning the card on the support carriage via impingement of the card with the abutment element and via an abutment structure having a first abutment portion with a first abutment surface for the card and having a second abutment portion with a second abutment surface for the support carriage, wherein the first and second abutment surfaces are spaced a first distance from each other;

prior to placing the card, locating the support carriage in a first position in which the support carriage is interposed between the output of the extraction station and the abutment element and in which the main edge is spaced from the second abutment surface a second distance that is greater than the first distance;

wherein, after the card is placed, the card extends at least in part beyond the main edge of the plate-like element so that the main side of the card is spaced a third distance from the main edge of the plate-like element that is greater than the first distance, and the method further comprises moving, in a first movement, the carriage in a second direction transverse to the first direction toward the abutment structure so that the main side of the card impinges on the first abutment portion to stop at the first abutment surface and the main edge of the plate-like element subsequently impinges on the second abutment portion to stop at the second abutment surface;

transporting the card to a printing station via a main movement of the support carriage; and activating the printing station for dot printing on the card.

2. The method according to claim 1, further comprising keeping the card in abutment with the abutment element while the first movement is performed.

3. The method according to claim 1, wherein the abutment element defines a main abutment surface for the card that is transverse to the first and second abutment surfaces.

4. The method according to claim 3, wherein the main abutment surface is perpendicular to the first and second abutment surfaces.

5. The method according to claim 1, wherein the first and second directions are perpendicular to each other.

6. The method according to claim 1, wherein the first abutment surface is parallel to the second abutment surface.

7. The method according to claim 1, wherein the abutment structure comprises a base portion to which the first and second abutment portions integrally mounted.

8. The method according to claim 1, wherein, in the first position, the carriage is closer to the second abutment portion than to the first abutment portion.

9. The method according to claim 1, wherein, after the main edge of the plate-like element impinges on the second abutment portion, the method further comprises performing a second movement of the carriage in the second direction for a preset additional path.

10. The method according to claim 1, wherein the carriage is slidably mounted on a guide plate having a first portion interposed between the output of the extraction station and the abutment element and at least a second portion at the printing station, wherein the first position is defined on the guide plate, and wherein the main movement, the first movement and the second movement of the carriage are carried out by moving the carriage on the guide plate.

11. The method according to claim 10, wherein the carriage has a first end that is slidably and rotatably mounted with respect to the guide plate and a second end is slidably mounted on said guide plate, and wherein the guide plate is structured and arranged so that, when the carriage is in the first position, the plate-like element is in a tilted condition relative to a base structure and, when the carriage is in the second position, the plate-like element is substantially parallel to the base structure.

12. The method according to claim 11, wherein the plate-like element is rigidly mounted on a first support element arranged at the first end of the carriage and on a second support element arranged at the second end of the carriage.

13. The method according to claim 12, wherein the first support element has an end rigidly connected with the plate-like element and a through aperture for engaging a rod substantially parallel to the guide plate.

14. The method according to claim 13, wherein the second support element has an end rigidly connected with the plate-like element, and an opposite end slidably engaged with the guide plate.

15. The method according to claim 14, wherein the first portion of the guide plate includes a first zone with which the second support element abuts when the carriage is in the first position, and the second portion of the guide plate includes a second zone, with which the second support element abuts when the carriage is in the second position, and wherein the first zone is located at a lower height than the second zone with respect to the base structure.

16. The method according to claim 1, further comprising activating a suction system to secure the card to the plate-like element.

17. The method according to claim 16, wherein the plate-like element has one or more through holes through which the suction system acts on the card.

18. The method according to claim 17, wherein the suction system comprises a pump and at least a conduit having a first end engaged with the pump and a second end engaged with the plate-like element for connecting the through holes with the pump.

19. The method according to claim 16, wherein the transporting of the card to a printing station occurs after the suction system is activated.

20. The method according to claim 1, wherein the card has a substantially plate-like shape with a substantially rectangular shape in a plan view with a larger side and a smaller side.

21. The method according to claim 1, wherein the printing station ink jet prints on the card.

22. A dot printer for cards comprising:

a carriage including at least a plate-like element structured and arranged for supporting a card having a main side, the plate-like element having at least a main edge;

an extraction station structured and arranged to place the card on the support carriage;

a printing station structured and arranged to dot printing on the card;

an abutment element structured and arranged to face an output of the extraction station;

an abutment structure that is oriented transverse to the abutment element and includes a first abutment portion structured and arranged to define a first abutment surface for the card and a second abutment portion structured and arranged to define a second abutment surface for the carriage, the first abutment surface having a first distance greater than zero from the second abutment surface; and a control system structured and arranged to control the extraction station to place the card on the support carriage in such a manner that the card reaches the abutment element, to move the carriage so that the main side of the card reaches the first abutment surface and the main edge of the plate-like element reaches the second abutment surface, and to move the carriage to the printing station.

23. A method for dot printing on cards comprising:

receiving a card on a plate-like element of a carriage, wherein a lateral movement of the card one of on or above the plate-like element is stopped by an abutment element;

moving the plate-like element and card in a direction crosswise to the lateral movement until a main side of the card abuts a first abutment surface of an abutment structure and a main edge of the plate-like carrier abuts a second abutment surface of the abutment structure, wherein the first abutment surface and the second abutment surface are not coplanar;

transporting the plate-like element and the card in a direction away from the abutment structure to a printing station; and activating the printing station for dot printing on the card.

* * * * *

UNITED STATES PATENT AND TRADEMARK OFFICE

CERTIFICATE OF CORRECTION

PATENT NO. : 8,960,669 B2
APPLICATION NO. : 14/124410
DATED : February 24, 2015
INVENTOR(S) : Paolo Cappello et al.

It is certified that error appears in the above-identified patent and that said Letters Patent is hereby corrected as shown below:

On the Title Page, at Item (73) Assignee, of the printed patent, "SICPA Holding SA" should read --SICPA HOLDING SA--

In the Claims

Column 13, line 57 (claim 7, line 3) please change "portions integrally" to --portions are integrally--

Column 14, line 55 (claim 21, line 2) please change "ink jet" to --ink-jet--

Signed and Sealed this
Twenty-ninth Day of December, 2015

Michelle K. Lee

Michelle K. Lee
*Director of the United States Patent and Trademark Office*